US005211799A

United States Patent [19]

Madrzak

[11] Patent Number: 5,211,799

[45] Date of Patent: May 18, 1993

[54] DEVICE FOR FASTENING AN ADHESIVE STRIP ON THE WEB END AND ON THE PAPER ROLL FORMED BY THE WEB

[75] Inventor: Zygmunt Madrzak, Heidenheim, Fed. Rep. of Germany

[73] Assignee: J. M. Voith GmbH, Fed. Rep. of Germany

[21] Appl. No.: 719,807

[22] Filed: Jun. 24, 1991

[30] Foreign Application Priority Data

Jul. 5, 1990 [DE] Fed. Rep. of Germany ..... 4021443

[51] Int. Cl.[5] ..... B65H 21/00; B32B 31/00

[52] U.S. Cl. ..... 156/518; 156/510; 156/502; 156/504; 156/505; 156/519; 242/58.1; 242/58.5

[58] Field of Search ..... 242/58.1, 58.5; 156/502, 504, 505, 518, 510, 522, 519, 444, 584

[56] References Cited

U.S. PATENT DOCUMENTS

| | | | |
|---|---|---|---|
| 2,441,164 | 5/1948 | Miller | 156/518 X |
| 2,990,081 | 6/1961 | De Neui | 156/521 X |
| 3,765,992 | 10/1973 | Stageberg | 156/584 X |
| 4,169,752 | 10/1979 | Tokuno | 156/504 X |
| 4,170,506 | 10/1979 | Marschke | 242/58.1 X |
| 4,190,483 | 2/1980 | Ryan | 156/505 X |
| 4,264,401 | 4/1981 | Ganz | 242/58.1 X |
| 4,331,301 | 5/1982 | Martinez | 242/58.1 |
| 4,492,609 | 1/1985 | Blom | 156/510 X |
| 4,802,632 | 2/1989 | Fukuda | 156/504 X |
| 4,905,924 | 3/1990 | Moore | 242/58.5 |

*Primary Examiner*—David A. Simmons
*Assistant Examiner*—Charles Rainwater
*Attorney, Agent, or Firm*—Baker & Daniels

[57] ABSTRACT

A support beam supports a box type beam on which there is located, essentially tangentially to the shell surface of a guide roll coordinated with it, a contact surface for the adhesive tape. Perpendicular to the contact surface, a holding slot for the adhesive tape is provided on the box-shaped beam. The adhesive tape protrudes out of this holding slot with a considerable part, of which the cover foil is removed. A blowing device or blowing channels with blowing orifices bend the part of the adhesive tape protruding out of the slot upward so that, with the support beam approaching the guide roll, this part of the adhesive tape practically is in contact with the contact surface. In this way, the adhesive tape can be fastened on the web end wrapping around the guide roll.

16 Claims, 4 Drawing Sheets

DEVICE FOR FASTENING AN ADHESIVE STRIP ON THE WEB END AND ON THE PAPER ROLL FORMED BY THE WEB

BACKGROUND OF THE INVENTION

In the production of coated paper it is necessary to provide a connection between the leaving end of a paper roll and the lead end of a new paper roll, for which purpose usually an adhesive tape or adhesive strip is used. These tapes or strips are generally provided with a double-sided coat of adhesive. The application of the adhesive tape or strip on the end of the web and on the paper roll formed by the web is correspondingly laborious. This operation has been performed thus far using a rather cumbersome manual procedure.

The problem underlying the invention, therefore, is to provide a device wherein the individual processes are performed essentially mechanically.

SUMMARY OF THE INVENTION

The solution to this problem is achieved with an adhesive tape which is coated with adhesive essentially on one side and features on its other side an additional adhesive coating only in the area of a longitudinal edge, using a device defined by the claims of the present invention.

A support beam is arranged near a guide roll, which guide roll is arranged parallel to the support beam. The support beam features in its longitudinal expanse a contact surface for the adhesive strip which is to be applied on the outer web end (web leader) of a paper roll. A holding slot for the adhesive strip is contained below the contact surface and borders immediately on it. The holding slot is parallel to the longitudinal axis of the support beam, and the width of the slot is dimensioned for the part of the adhesive surface of the adhesive strip that later serves to make a splice, which is still covered by a protective foil. A blade is provided which has its cutting ed directly below, or in the lower plane of the holding slot. The support beam is arranged so as to be pivotable about an axle which is parallel to its longitudinal axis, preferably about a lateral axle located near the guide roll.

The procedure is such that the guide roll is located near the new, replacement paper roll, so that the end of the paper web of which the paper roll is being wound can be folded over the guide roll. The end of the paper web is then cut off at a specific point, at which also, through a retaining surface held by a support beam, the adhesive tape held in a slot in the support beam is attached to the new end of the paper web. The adhesive support beam is attached to the new end of the paper web. The adhesive strip protrudes out of the slot only with that part whose adhesive surface part is exposed for tacking the paper web, i.e., is generally freed first of a cover foil. This end is brought by a blowing device in the vicinity of the contact surface, where the adhesive strip, in cross section, is formed into an angle.

BRIEF DESCRIPTION OF THE DRAWINGS

The invention will be explained hereafter with the aid of the embodiments described in the figures of the drawings.

DESCRIPTION OF THE PREFERRED EMBODIMENT

Figure 1:
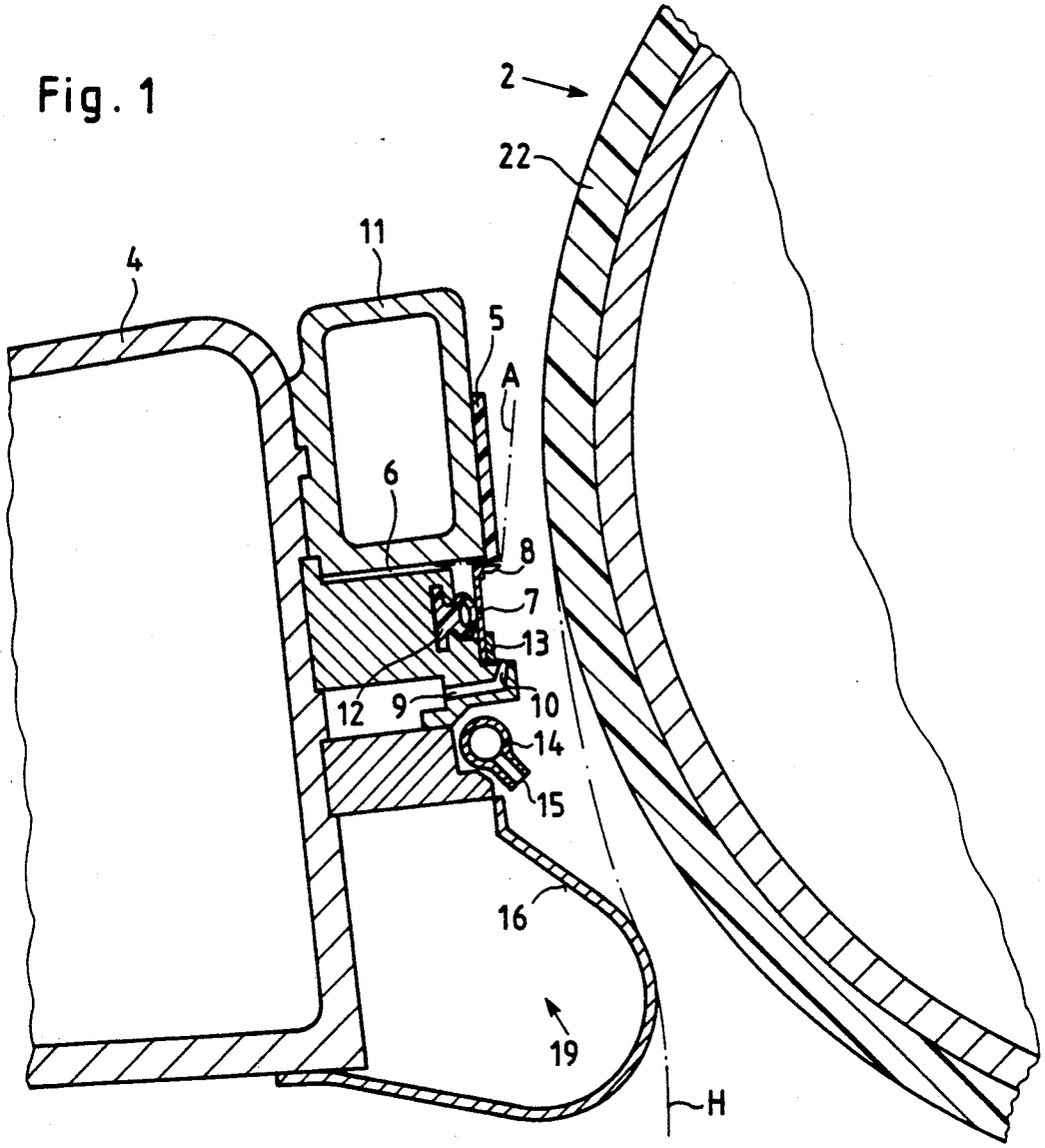
FIG. 1 shows a cross section, partly in cut-away illustration, of the support beam and the guide roll.

In FIG. 1, the web edge H separated from the paper roll C lies over the guide roll 2, hanging down on its left side. Fashioned as a hollow roll, the guide roll features a rubber-elastic shell 22 of plastic. Located approximately at the level of the center axis of the guide roll is a contact surface 5, which is formed here by a strip of rubber-elastic material. It is fastened on a box-shaped support 11 which is held by the support beam 4. Said support beam, the same as the box-shaped support 11 and the cont act strip 5, is arranged parallel to the center axis of the guide roll 2 and paper roll C and has a pivot axle 19 which also has the same direction.

Also in this direction and arranged with the same length, a holding slot 6 is located below the box-shaped support 11, along with a blade 7 provided with a cutting edge 8, which blade is fashioned as a spring steel angle. This blade is brought in cutting position by means of a pressure hose 12. The blade is attached to the support beam 4 by means of a clamping bar 13. Provided below the blade 7 are blowing channels 9 with orifice 10 for blowing air. Additional blowing channels 15 are located below these blowing channels and are connected to a central air channel 14 which also extends parallel to the center axis of the guide roll 2. Arranged below the blowing channels 15 is a guide surface 16, which generally consists of a thin steel sheet. As illustrated, this guide surface holds web edge H in a position suitable for cutting. It also facilitates the threading of th paper web and the unwinding of several meters of paper web from the paper roll.

Figure 2:
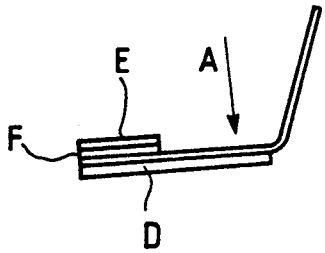
FIG. 2 shows a detail of the adhesive strip after deformation.

An adhesive tape is used which is completely covered with an adhesive layer essentially on one side, which layer is covered by a cover foil D subdivided in the longitudinal direction of the adhesive tape. On its other side, the adhesive tape features a narrow adhesive strip in the vicinity of its one longitudinal edge, which longitudinal strip consists of an adhesive layer F and a cover foil E. In FIG. 2, the adhesive tape A is illustrated in its position in the slot 6, in which it is contained after being sucked up and after the part that is already rid of its cover foil has been blown upward by the blowing orifices 10. The cover foil is removed only after the adhesive tape has been sucked completely onto the surfaces 5 and 6. As the nozzles 10 blow, the surface 5 is subjected to suction, so that the adhesive tape will be in direct contact with the surface 5.

Upon further approach of the support bem 4 or the contact surface 5, by pivoting the support beam about the pivot axle 19, the connection of the adhesive tape with the web end can then be made in this position, with the excess web end H being separated by the blade 7. The plastic shell 22 of the guide roll 2 is to be provided also for that purpose. A plastic that has been found to be well-suited is polyurethane. The blade 7 severs with its cutting edge 8 the excess web end practically directly below the beginning of the contact surface 5, so that the adhesive tape is tacked to the paper web end, practically butt on butt, with regard to the remaining cover foil part D.

Following the taping, the removal of the adhesive tape from the slot can be facilitated possibly by changeover from suction to blowing on the surfaces 5 and 6.

Figure 3:
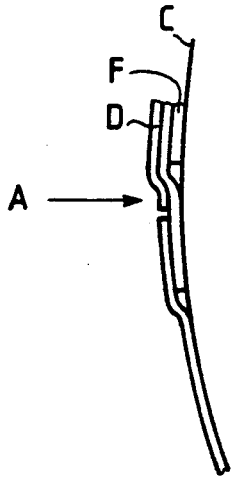
FIG. 3 shows another detail of the adhesive strip in relation to the paper roll.

FIG. 3 shows the position of the adhesive tape after the web end has been rewound onto the paper roll. Also the cover foil E of the small adhesive tape has been removed here, so that the end of the paper web could be fastened tightly on the paper roll C by means of the adhesive tape A. The latter is stil provided with the second cover foil part D. Shortly before the start of the actual splicing operation, this cover foil part is eventually removed.

The blowing air channels 15 serve to deflect the web end H, without human intervention, into the proper position and downward.

Figures 4, 5:
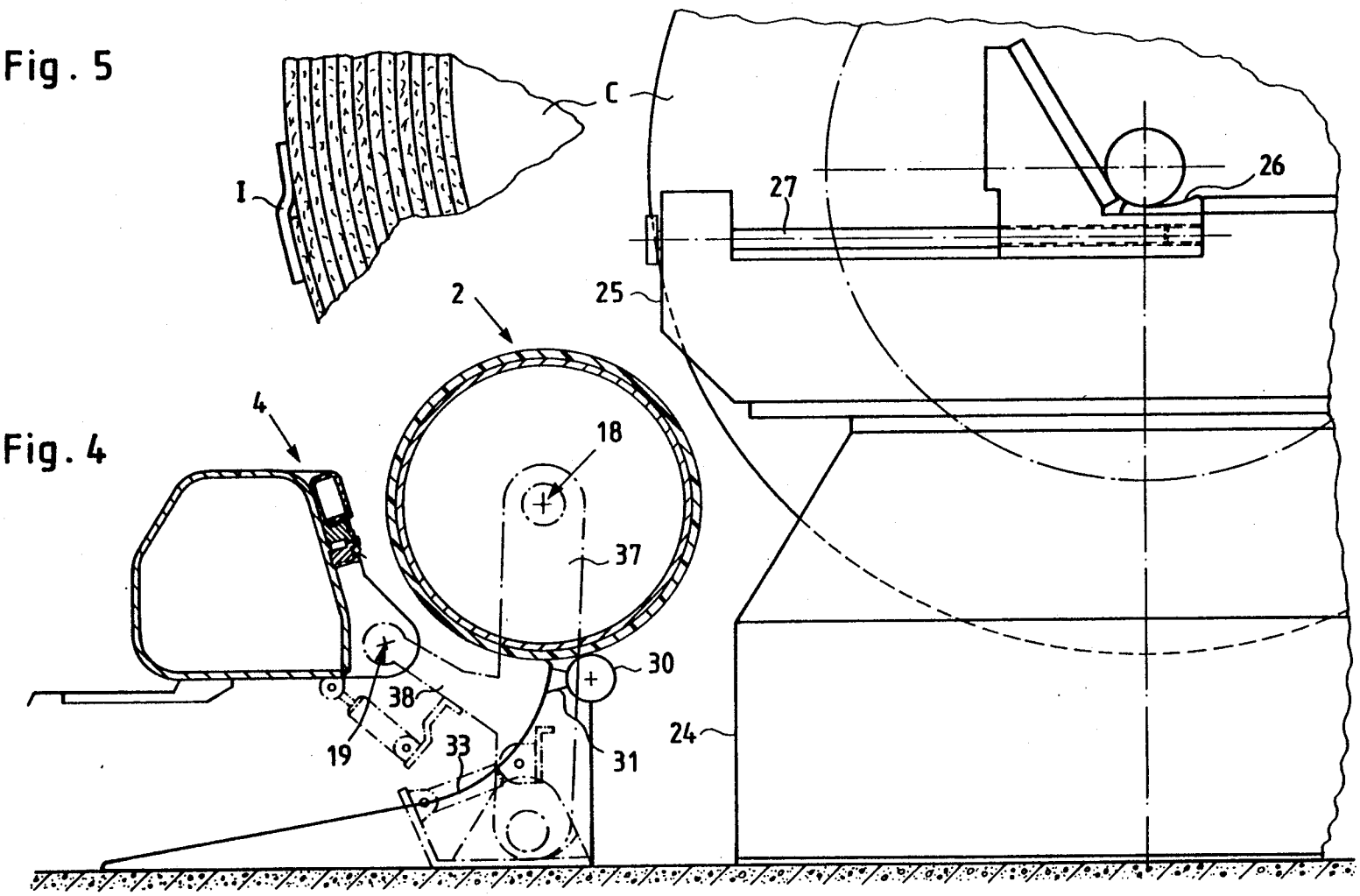
FIG. 4 shows a side elevation, partially in cross section, of the overall setup.
FIG. 5 shows another detail, in cross section, of the unprocessed paper roll.

Regarding the approach of the guide roll 2 and paper roll C, reference is made to FIG. 4. In this case, the guide roll 2 is fixedly arranged (although rotatable about its center axis), and the approach of the guide roll 2 and paper roll C is brought about by the support of the paper roll C, which is adjustable in horizontal direction by means of lead screw 27. The actual support point 26 of the paper roll features an incline, as a result of which its support axle always has a specific position with regard to the paper roll support. This support 25 is contained on a paper roll carriage 24. Preparing the taping seam on a paper roll carriage is the most difficult case; normally, the paper roll is unloaded on a stand with an inclin track, using a hoist.

From this figure it can be seen that the contact surface located essentially at the same level as the center axis 18 of the guide roll 2. Additionally provided below the guide roll 2 is a deflection plate 33 for the paper web end H, where the web end can be removed from the guide roll 2 by means of blowing channels 31 connected to a central air channel 30. Additional blowing orifices of the air channel 30 direct air flows essentially tangentially to the guide roll into its lower area, forcing the web end H to slide off along the guide surface 33.

Illustrated in FIG. 5 on a detail is what the paper roll C with the adhesive tape looks like prior to the processing operation. Shown on the left side is the web end which by means of the adhesive strip I is attached to the periphery of the paper roll C.

In another embodiment, the support beam pivots about a central pivot axle. Correspondingly, the contact surface is then also of a curved design, with a center of curvature situated in this pivot axle. By rotating the guide roll by a corresponding angular amount, the adhesive tape can then also be attached to the web end, the application of which is called for when the diameter of the guide roll must be kept relatively small.

FIG. 4 also shows that the guide roll 2 as well ma be supported movably on lateral pivot arms 37 (illustrated by broken lines). Additional pivot arms 38 connected with these pivot arms and illustrated by broken lines then make it possible to swing the support beam 4 or the contact surface 5 toward the guide roll 2, by means of the indicated hydraulic power elements.

The guide roll 2 may be provided with bores in its shell, making it possible to suck the web end onto the shell surface of the guide roll 2 by means of a vacuum which is effective insid Moving the paper roll C into a position in which it makes contact with the guide roll 2 makes it possible, by rotation of the paper roll C by means of the guide roll coupled to a motor to advnnce the web end clockwise along the shell surface of the guide roll 2 toward the guide surfaces 16 and 33. In the opposite direction, the adhesive strip A is then firmly connected with the paper roll.

The entire setup should favorably be so provided that the guide roll will be arranged in a lower quadrant of the paper roll C, preferably so low that the common tangent from it and the paper roll C of maximum diameter extends essentially horizontally.

It is not absolutely necessary that a paper roll carriage be used in the process of fastening the adhesive strip on the paper roll. Instead, also a stand could be used which as a holding surface favorably features an incline, so that the paper roll, due to this incline, will make contact with the guide roll 2 at a certain contact pressure.

On the other hand, this stand could feature also levers which slow the axle of the paper roll down through pneumatic power elements or also push it forward, so that a controlled contact force of the paper roll C on the guide roll 2 could be generated.

The viewpoint in general is that the setup can be operated by the personnel without catwalks.

There are two possibilities of taping seam preparation:

I: The guide roll is "stationary"; the beam is pivotable. Depending on diameter, the paper roll must then be fed to the guide roll, for instance the paper roll is placed by means of a hoist on an "incline" or is pushed toward the guide roll on a paper roll carriage, for instance by means of a lead screw. Contact pressure is generated either by means of hydraulic cylinders or through the "dead weight component" in horizontal direction.

II: In this variant, the paper roll is stationary. Depending on its diameter, the entire device (guide roll and beam) must then be pivoted onto the paper roll.

The adhesive tape is favorably inserted in the slot 6 by means of a conveyer belt, for instance a flat belt.

In a preferred embodiment, the diameter of the guide roll is at least 500 mm.

Figure 6:
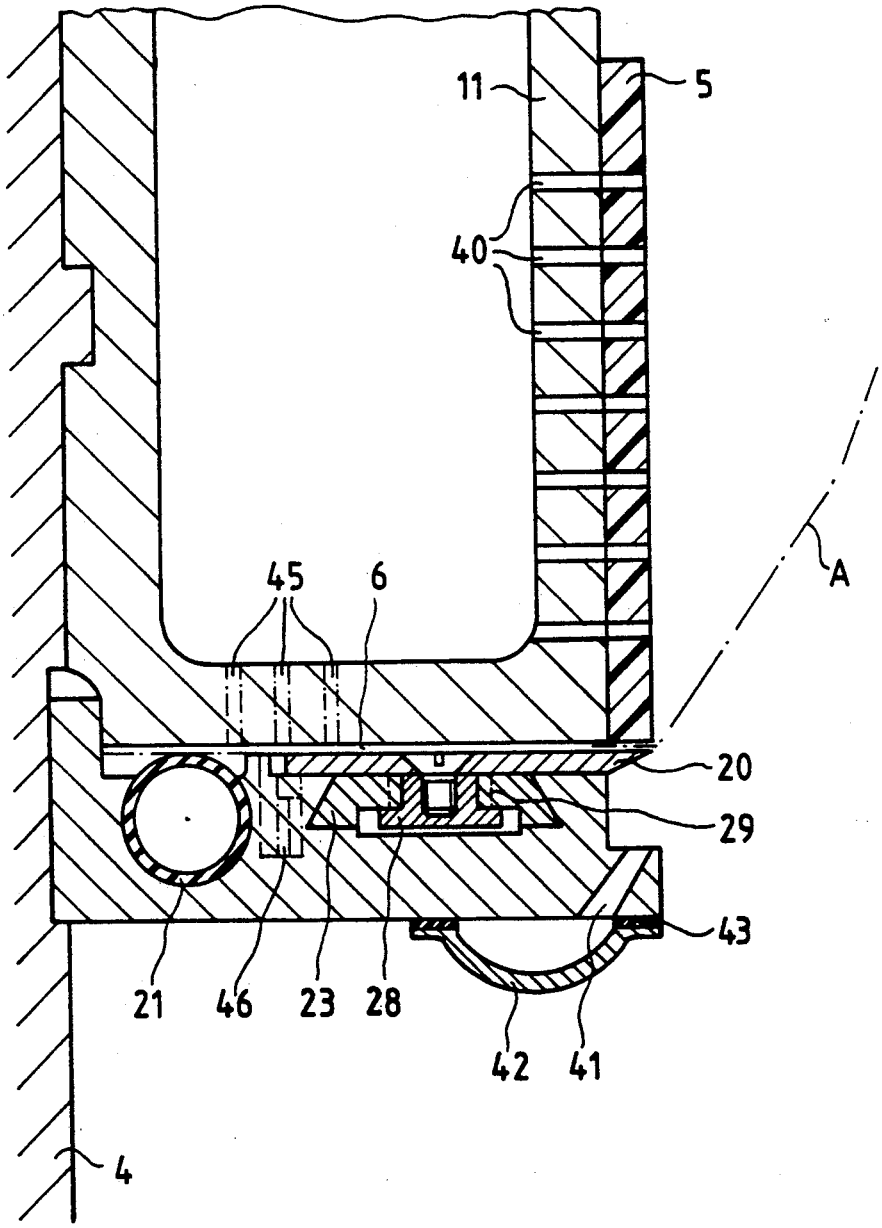
FIG. 6 shows, cross-sectionally, a scaled-up cross section of the support beam with a modified blade.

In the embodiment according to FIG. 6, a blade 20 is provided which extends completely parallel to the plane of the slot 6 and is arranged also so as to be movable only in this direction. The blade is held by a guide bar 23 which is installed in a dovetailing, and by guide blocks 28 screwed to the blade. These guide blocks are installed in slanted slots 29 in the guide bar 23. When the latter is moved axially, i.e., in the direction of its longitudinal axis, the blade is shifted transverse to this moving direction, thereby severing the excess paper web end at the guide roll 2, once the adhesive strip is making complete contact with the contact surface 5. This figure also illustrates the suction openings 40 that lead from the hollow support 11 to the contact surface 5 and extend through it. Also present are the blowing orifices 41 connected to the blowing air channel 42, which is sealed relative to the support beam by means of seals 43. Additional suction openings 45 may be provided in the hollow support 11 in order to fix the adhesive strip in the slot 6. This, however, is possible also (for instance when not using a hollow support 11) through a pressure hose 21. This latter, instead of the guide bar 23, could also actuate the blade 20 if on its end facing the pressure hose it features a pressure bar, which is illustrated by broken line. The blade would then return to home position by means of band springs 46, also illustrated by dash-dot line.

Figure 7:
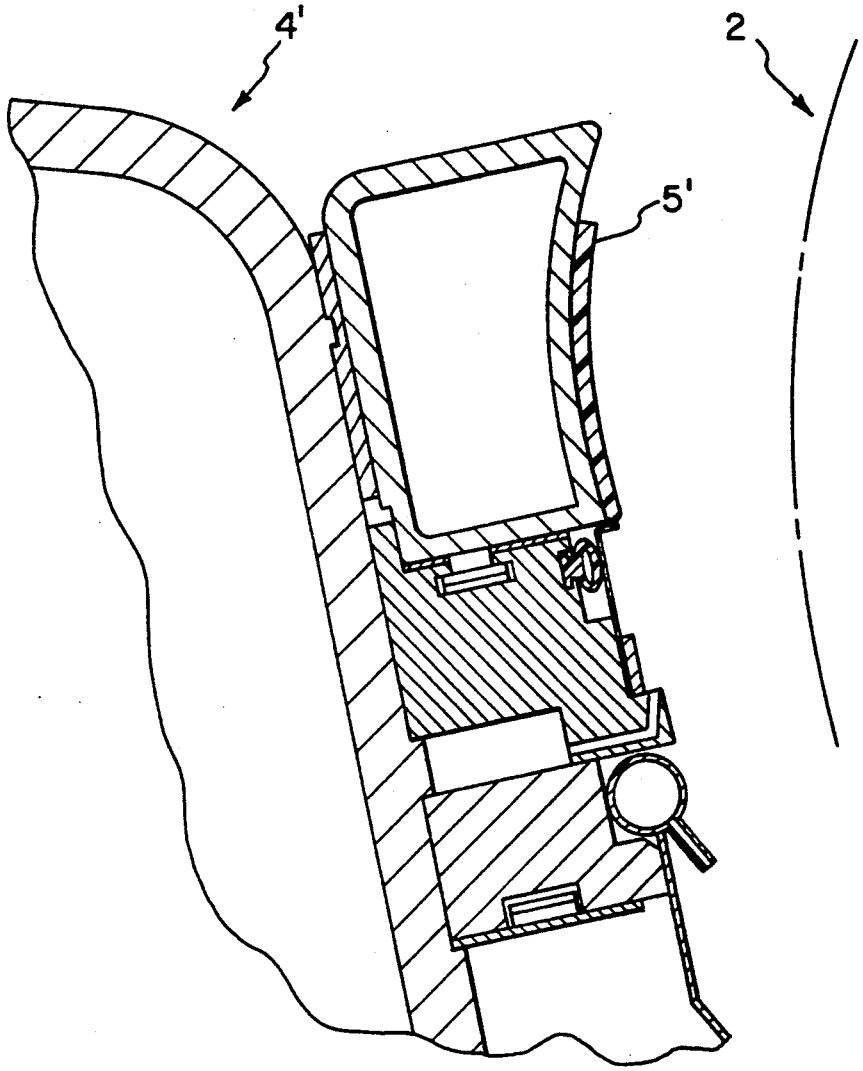
FIG. 7 shows, in cross section, a further embodiment wherein contact surface 5' is curved.

In the embodiment according to FIG. 7, contact surface 5' is curved, with a center axis of curvature extending parallel to the pivot axle of the support beam 4', which essentially extends centrally with support beam 4'. Preferably, the curvature of contact surface 5' mates with the outer cylindrical surface of guide roll 2. The axis of curvature is offset towards the center line of the guide roll.

While this invention has been described as having a preferred design, the present invention can be further modified within the spirit and scope of this disclosure. This application is therefore intended to cover any variations, uses, or adaptations of the invention using its general principles Further, this application is intended to cover such departures from the present disclosure as come within known or customary practice in the art to which this invention pertains and which fall within the limits of the appended claims.

What is claimed is:

1. A device for the application of an adhesive strip on an end of a web wound on a paper roll, said adhesive strip having an adhesive surface wherein at least a portion of said adhesive surface is covered by a protective foil, said device comprising:

a guide roll spaced from said paper roll;

a support beam situated in closely spaced arrangement to said guide roll and parallel thereto, said support beam having a longitudinal expanse, said support beam further having in said longitudinal expanse a contact surface for said adhesive strip, said contact surface being situated so that a holding slot for said adhesive strip is defined immediately therebelow and bordering on said contact surface, wherein a part of said adhesive strip protrudes from said holding slot, said holding slot being arranged generally parallel to the longitudinal axis of said support beam, said holding slot having a width dimensioned for the part of said adhesive surface covered by said protective foil, said covered part being adaptable to make a splice for said paper roll;

a blade positioned below said holding slot, said blade having a cutting edge for severing a portion of said web from said paper roll; and blowing means positioned generally below the holding slot for raising said protruding part of the adhesive strip.

2. The device according to claim 1, wherein said support beam is pivotable about an axle, said axle being arranged generally parallel to the longitudinal axis of said support beam and situated in closely spaced relationship with said guide roll.

3. The device according to claim 2, including a guide surface for guiding downward the portion of said paper web severed by said blade cutting edge, said guide surface partially surrounding said pivot axle and being situated in closely spaced relationship with said guide roll, said device further including blowing elements for directing an air jet generally laterally and downward essentially toward the lowermost point of the guide roll arranged above said guide surface.

4. The device according to claim 1, wherein said blade comprises an angular spring blade, and is arranged so as to pivot essentially perpendicularly to said contact surface of the support beam.

5. The device according to claim 4, in which said holding slot has a discharge end for discharging said adhesive strip, said angular spring blade having an angled end provided with said cutting edge, wheren said blade is situated generally at said discharge end.

6. The device according to claim 4, including a contact element for said blade, wherein said contact element comprises a pressure hose.

7. The device according to claim 5, including a contact element for said blade, wherein said contact element comprises a pressure hose.

8. The device according to claim 1, including means for adjustably changing the spacing between said guide roll and said paper roll.

9. The device according to claim 1, wherein said guide roll has a rubber-elastic shell, said guide roll being arranged below the center of support of said paper roll.

10. The device according to claim 9, in which the diameter of said guide roll is at least 500 mm, wherein said contact surface of said support beam is flat and arranged essentially tangentially relative to said guide roll as tape is transferred to said paper roll.

11. The device according to claim 2, wherein said contact surface is curved and has a center axis of curvature, said center axis of curvature extending parallel to said pivot axle of the support beam, said pivot axle extending essentially centrally within said support beam.

12. The device according to claim 11, wherein said axis of curvature is configured to mate with the outer cylindrical surface of said guide roll.

13. The device according to claim 1, including a hollow beam for supporting said contact surface, and further including suction openings passing from the interior of said hollow beam through said contact surface.

14. The device according to claim 1, in which said guide roll has a shell surface, and wherein at least one of said contact surface and said shell surface consists of rubber-elastic material.

15. A device for the application of an adhesive strip on an end of a web wound on a paper roll, said adhesive strip having an adhesive surface wherein at least a portion of said adhesive surface is covered by a protective foil, said device comprising:

a guide roll spaced from said paper roll;

a support beam situated in closely spaced arrangement to said guide roll and parallel thereto, said support beam being pivotable about an axle and having a longitudinal expanse, said axle being arranged generally parallel to the longitudinal axis of the support beam and situated in closely spaced relationship with the guide roll, said support beam further having in said longitudinal expanse a contact surface for said adhesive strip, said contact surface being situated so that a holding slot for said adhesive strip is defined immediately therebelow and bordering on said contact surface, said holding slot being arranged generally parallel to the longitudinal axis of said support beam, said holding slot having a width dimensioned for the part of said adhesive surface covered by said protective foil, said covered part being adaptable to make a splice for said paper roll;

a blade positioned below said holding slot, said blade having a cutting edge for severing a portion ofs aid web from said paper roll;

a guide surface for guiding downward the portion of the paper web severed by the blade cutting edge, said guide surface partially surrounding said pivot axle and being situated in closely spaced relationship with the guide roll; and blowing elements for directing an air jet generally laterally and downward essentially toward the lowermost point of the guide roll arranged above the guide surface.

16. A device for the application of an adhesive strip on an end of a web wound on a paper roll, wherein a guide roll for the paper web is utilized to guide the web onto the paper roll, said guide roll being spaced from the paper roll, the adhesive strip having an adhesive surface wherein at least a portion of said adhesive surface is covered by a protective foil, said device comprising:

a supporg beam situated in closely spaced arrangement to the guide roll and parallel thereto, said support beam having a longitudinal expanse, said support beam further having in said longitudinal expanse a contact surface for said adhesive strip, said contact surface being situated so that a holding slot for said adhesive strip is defined immediately therebelow and bordering on said contact surface, wherein a part of said adhesive strip protrudes from said holding slot, said holding slot being arranged generally parallel to the longitudinal axis of said support beam, said holding slot having a width dimensioned for the part of said adhesive surface covered by said protective foil, said covered part being adaptable to make a splice for said paper roll;

a blade positioned below said holding slot, said blade having a cutting edge for severing a portion of said web from said paper roll; and blowing means positioned generally below the holding slot for raising said protruding part of the adhesive strip.

* * * * *